United States Patent [19]

Cooper

[11] Patent Number: 4,812,082

[45] Date of Patent: Mar. 14, 1989

[54] UNDERGROUND SURGE IRRIGATION SYSTEM

[76] Inventor: Robert L. Cooper, Rt. 2, Box 132, Ulysses, Kans. 67880

[21] Appl. No.: 29,617

[22] Filed: Mar. 24, 1987

[51] Int. Cl.[4] ..... E02B 11/00; F16K 11/07

[52] U.S. Cl. ..... 405/36; 137/887; 405/39

[58] Field of Search ..... 405/36–39, 405/43–48; 137/887, 883, 627

[56] References Cited

U.S. PATENT DOCUMENTS

| | | | |
|---|---|---|---|
| 935,566 | 9/1909 | Twiford | 137/883 |
| 998,253 | 7/1911 | McCrimmon | 137/883 X |
| 1,503,394 | 7/1924 | Vacher | 137/883 X |
| 2,979,082 | 4/1961 | Neves | 405/36 X |
| 3,003,514 | 10/1961 | Furlong | 137/627 X |
| 3,331,207 | 7/1967 | McGrew et al. | 405/39 |
| 4,566,494 | 1/1986 | Roche | 137/887 X |
| 4,577,802 | 3/1986 | Keller et al. | 405/36 X |
| 4,711,272 | 12/1987 | Wiseman | 137/887 |

*Primary Examiner*—Dennis L. Taylor

*Attorney, Agent, or Firm*—Frisenda, Morris & Nicholson

[57] ABSTRACT

An irrigation device designed to change the water flow in the main supply pipe (underground) to different directions for a timed period, then switch back. A timer in a control-box determines the switching cycles. A butterfly-valve actually changes the direction of the water flow, and an extension converts the power applied from the control-box to the valve body. This underground surge irrigation system is designed for furrow flood irrigation and some forms of sprinkler irrigation to increase the efficiency of the water applied, for a more uniform soak profile through the whole field.

12 Claims, 6 Drawing Sheets

UNDERGROUND SURGE IRRIGATION SYSTEM

BACKGROUND OF THE INVENTION

1. Field of the Invention

The present invention relates to irrigation systems, particularly it relates to flood irrigation. In irrigating a field by flowing water through a furrow, it has been found in the art that after a period of time, under flood irrigation, the speed with which the water percolated downward increases with time. Thus, as the soil becomes saturated with the water there is little or no further movement away from the water source since the water will move downward in the saturated soil faster than it will move further forward into the fields. Consequently, controlled surge irrigation systems have been proposed in which the water is dispensed to the furrows for a pre-selected period of time which is less than or equal to the time it takes for the soil to be saturated. The water is then turned off for a period of time for the water to recover from the initial water surge. During the second dispensing of water, the water will travel further along the field before the soil is saturated due to the fact that the water initially will travel faster down the already wetted and slick furrow. The procedure will then be repeated periodically until the water has travelled the desired distance in the field to be irrigated. The present invention relates to an improved method of performing surge irrigation in which the amount of piping and the number of surge valves required is reduced. Specifically, according to the present invention a surge valve is provided centrally underground within the main water supply and has the ability to periodically send water to multiple fields from a central control point.

2. Description of the Prior Art

Flood irrigation has been used for years to irrigate cultivated fields. In recent years there has been a more efficient way of controlling flood irrigation by the so-called surge irrigation using a surge valve such as Waterman Surge Valve H.P. 500. The surge irrigation is accomplished by off timing the flow of the water on a field to move the water forward faster than it will soak downward. Such surge irrigation results in a conservation of water and a reduction of power cost. A problem with the conventional surge irrigation systems is the need for multiple pieces of equipment to switch from one field to another and additional surface pipe to supply water to the center of the field to be watered. Moreover, it was necessary to set the surge valve in the center of the surface watering pipeline at equal distance from the left and right ends of the field to be watered.

SUMMARY OF THE INVENTION

The present invention provides a surge irrigation system for efficiently watering cultivated fields in a manner to conserve water and fuel costs. The surge irrigation system according to the subject invention includes a primary valve located on the underground water supply line beneath the cultivated fields. The valve has at least two outlet positions to direct the water flow through the valve in different directions which are connected to two underground irrigation pipes. The different outlet positions can be selected from the surface. A controller, including a timer is provided which can selectively direct the valve discharge between its outlet positions according to a predetermined time schedule. The water then flows on the predetermined time schedule through the pipes to the surface of the fields and flows into furrows and hence provides irrigation to the fields. Optionally a secondary valve having at least two selectable inlets which are surface controllable is provided underground in fluid communication with the outlets of the primary valve. The secondary valve is connected at its outlet to a third irrigation pipe. According to the invention, surge irrigation can be provided through any combination of two of the irrigation pipes. Thus, at least three different areas of the cultivated fields located in different directions can be selectively surge irrigated from a central location.

The present invention can also be applied to tow-line sprinkler or hand moved sprinkler systems. According to the invention one can automatically switch the lines off and on to help in the moving of the line (when off) and to also allow for better penetration (less run-off) of moisture as compared with a constant sprinkling in one spot.

DETAILED DESCRIPTION OF THE INVENTION

According to the present invention, a surge irrigation system is provided by locating a surface controllable valve having at least two outlets and an inlet on an underground water pipe. Preferably a second similar surface controllable valve with two inlets and a single outlet is also provided. The resulting surge irrigation system is a surface controllable surge irrigation system which allows surge irrigation of several fields without having either to switch equipment from field to field or having large amounts of duplicative equipment.

Figure 8A:
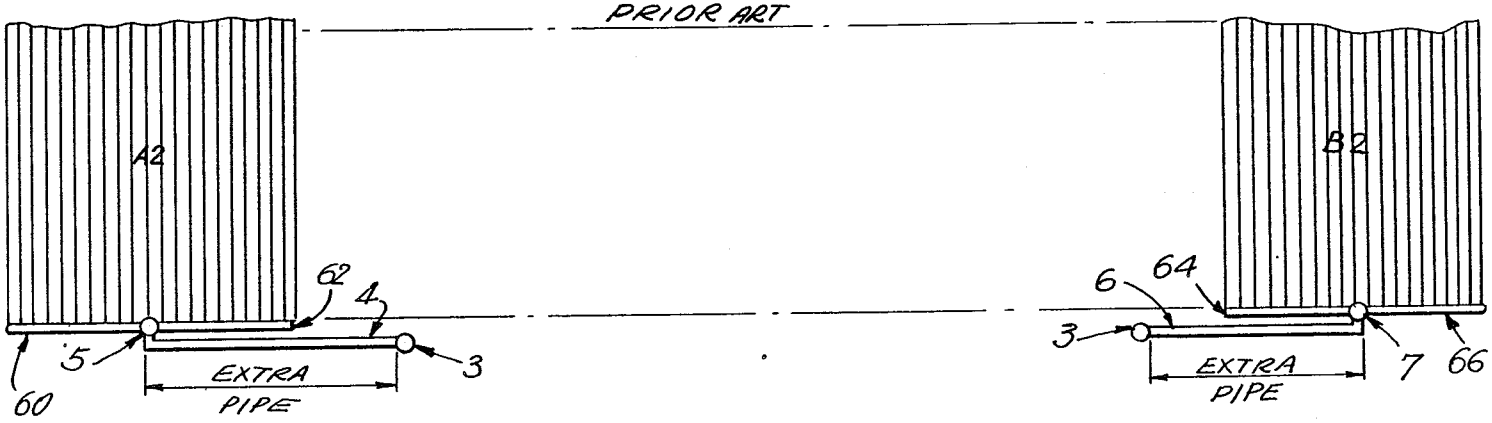
FIG. 8A PRIOR ART
FIG. 8A is a top view of a prior art field using conventional surge irrigation.
Figure 8B:
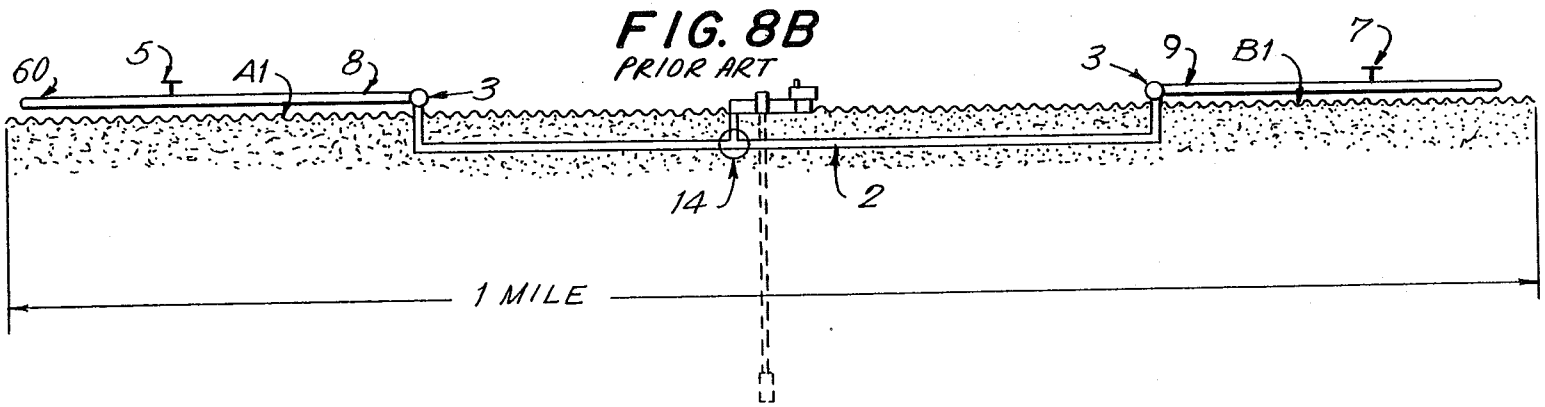
FIG. 8B PRIOR ART
FIG. 8B is a plan view of a prior art field using conventional surge irrigation.

This invention is particularly suitable for use in cultivated areas that already have underground irrigation piping installed. In conventional surge irrigation as shown in FIG. 8, an underground water pipe 2 is connected to a riser 3 into a supply pipe 4 to the center of the field A2. Surge valve 5 is then connected to supply pipe 4 and gated pipe 60 and 62 are laid to the left and right of valve 5. When one has finished watering A2, and another field B2 at the other end of the farm needs watering, one would need additional supply pipe 6 and an additional surge valve 7 as well as gated pipe 64 and 66 to do the watering. Another conventional alternative is to shut the water source down (e.g., a well) and move all the piping from A2 to B2. According to the invention, the need for additional piping and multiple surface surge valve is eliminated.

Figure 1:
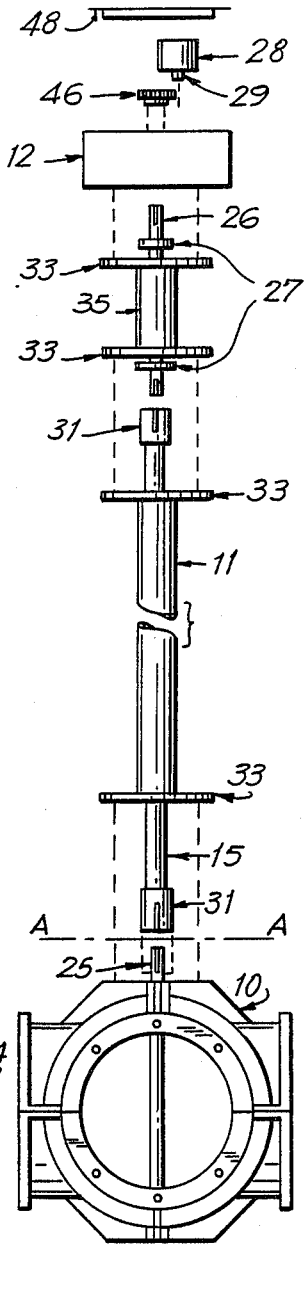
FIG. 1 is an exploded side view of the primary surge valve and control system according to the invention.
Figure 2:
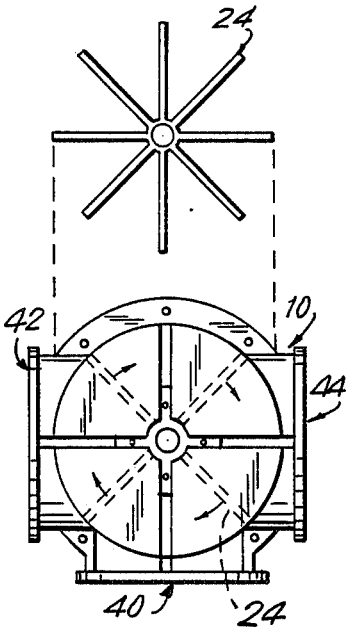
FIG. 2 is a downward view of the surge valve used in the present invention showing disc 24.
Figure 3:
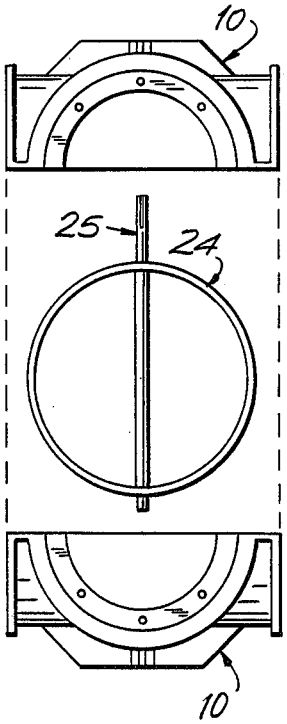
FIG. 3 is an unassembled view of the surge valve used in the present invention.

Referring to the preferred embodiments as shown in the appended drawing, according to the invention, as seen in FIG. 1, a primary surge valve 10 is connected to the underground water supply 17 through compression coupler 32. Valve 10 is preferably a butterfly disc valve such as the Waterman HP-500 having disc 24 which moves as shown in FIG. 2 to provide two flow outlet positions. Water enters inlet 40 and exits outlets 42 or 44 depending on whether disc 24 is set for right or left flow. Disc 24 is moved to either right or left setting by the action of motor 28 located above ground. A shaft 15 is connected to valve 10 for movement of disc 24 at keyed shaft 25 by keyed coupler 31. Shaft 15 fits into hollow tube 11 which is connected to valve 10 by flange 33. At the opposite end, shaft 15 and tube 11 extend above ground, a convenient distance for easy access. At the end of shaft 15 above ground, shaft 15 is connected through coupler 31 to keyed shaft 26 which has slip bearings 2 at either end. Tube 35 which encases keyed shaft 26 is joined to tube 11 by flange 33. At its opposite end, keyed shaft 26 is connected to keyed gear 46 which is rotated by a gear 29 attached to a motor 28 and hence the position of disc 24 can be selectively changed. Control box 12 houses the motor 28 and is attached to tube 35 through flange 33. Control box includes timer control 48 for automatically switching the position of disc 24 according to a predetermined schedule.

Figure 4:
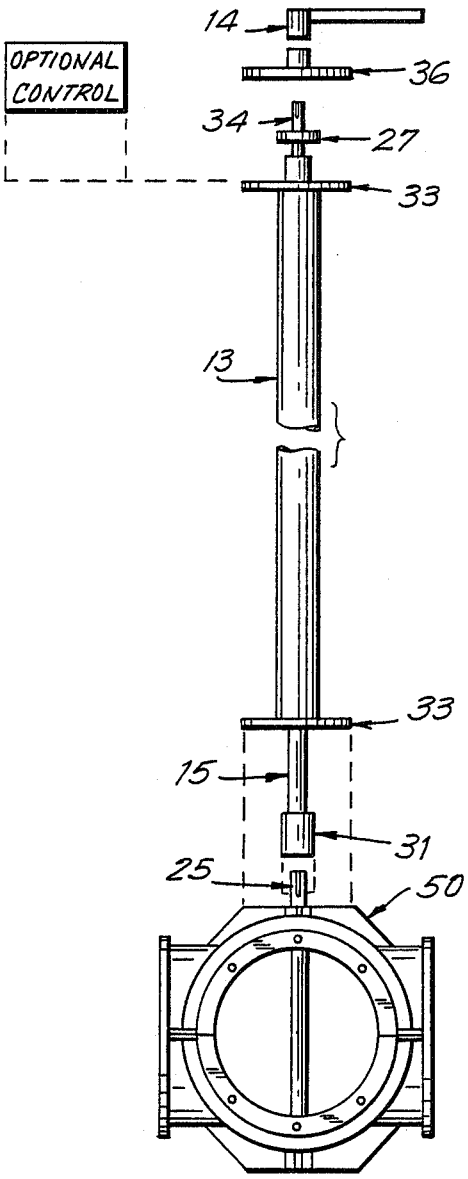
FIG. 4 is a side view of the secondary valve and control system according to the invention.
Figure 5:
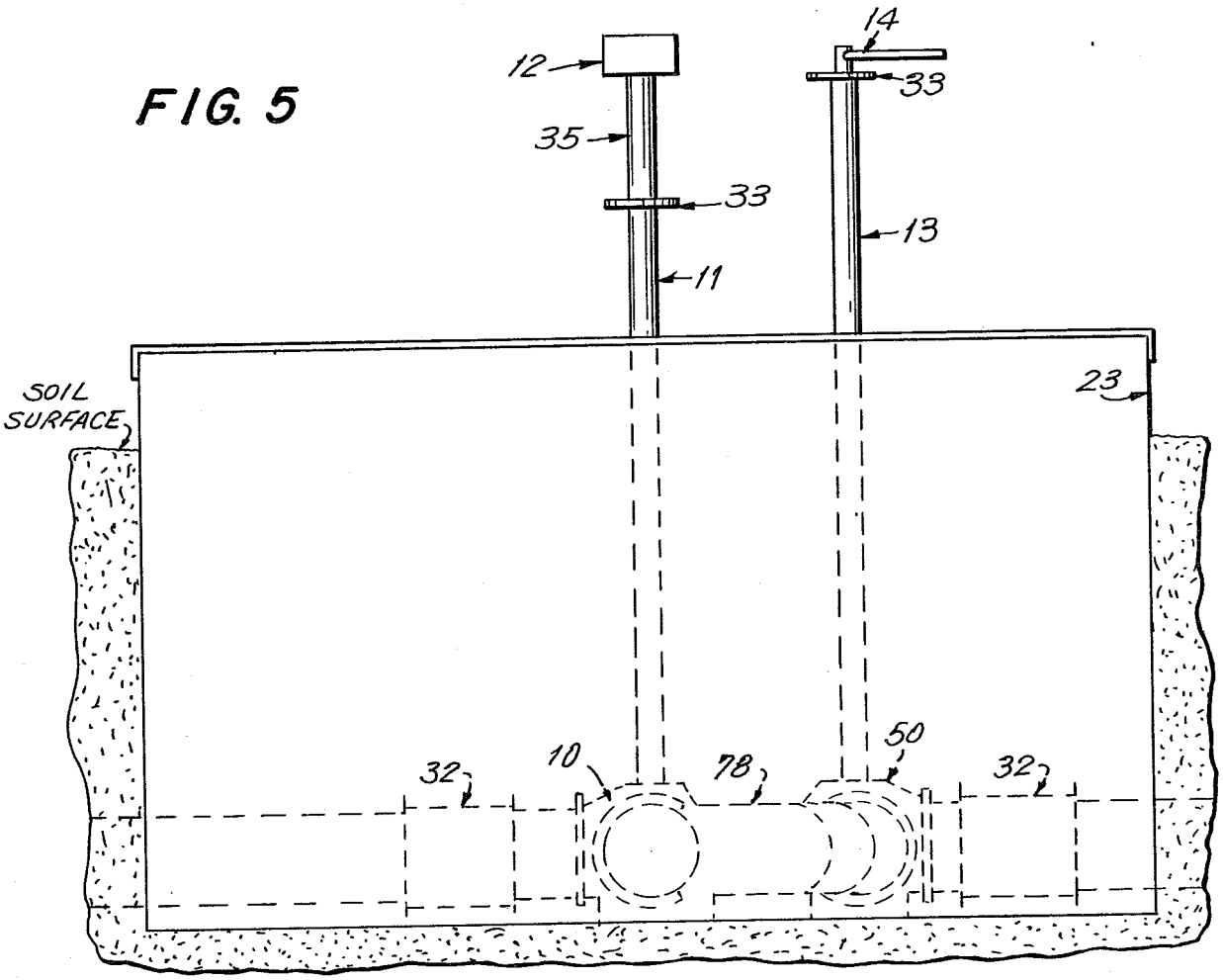
FIG. 5 is section of the surge irrigation system installed underground.

Referring to FIG. 2, FIG. 4 and FIG. 5, optionally a second valve 50 is provided. Preferably valve 50 is the same kind of valve as primary valve 10 and includes two inlet paths 70, and 72 and a single outlet 74. The two inlet paths are selectably engaged by movement of disc 24 in the same manner as described for valve 10. As shown, valve 50 is hand activated by the movement of lever 14 which position disc 24 by rotating keyed stub shaft 34 and shaft 15 to move disc 24. Manual control lever stop plate 36 is attached to flange 33. Optionally, valve 50 could be motorized and automatically controlled in the same manner as is valve 10.

Referring to FIG. 5 which shows a cross-section of FIG. 1 and FIG. 4 installed below ground with a casing 23. Casing 23 allows easy access to the embodiments for repair and inspection. The casing 23 has a lid to keep the cold temperatures from freezing the pipeline which usually contains water all year round.

Figure 6:
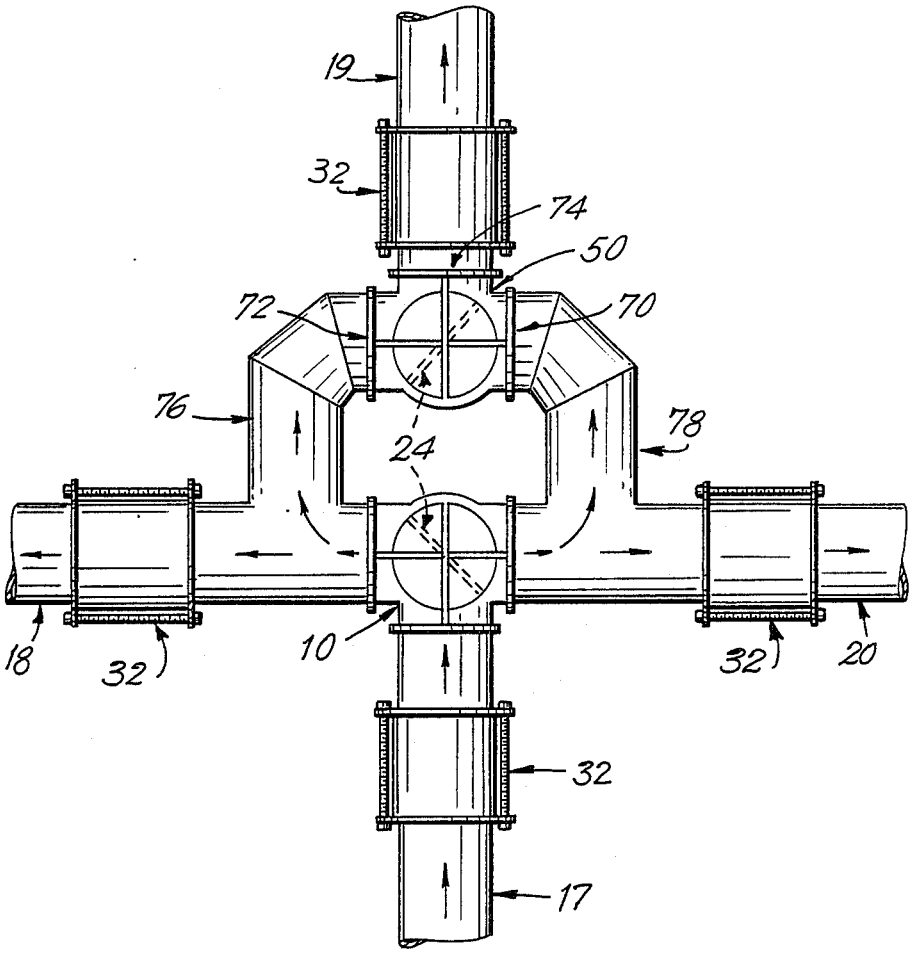
FIG. 6 is a section of FIG. 1 through lines A—A looking downwardly.
Figure 7:
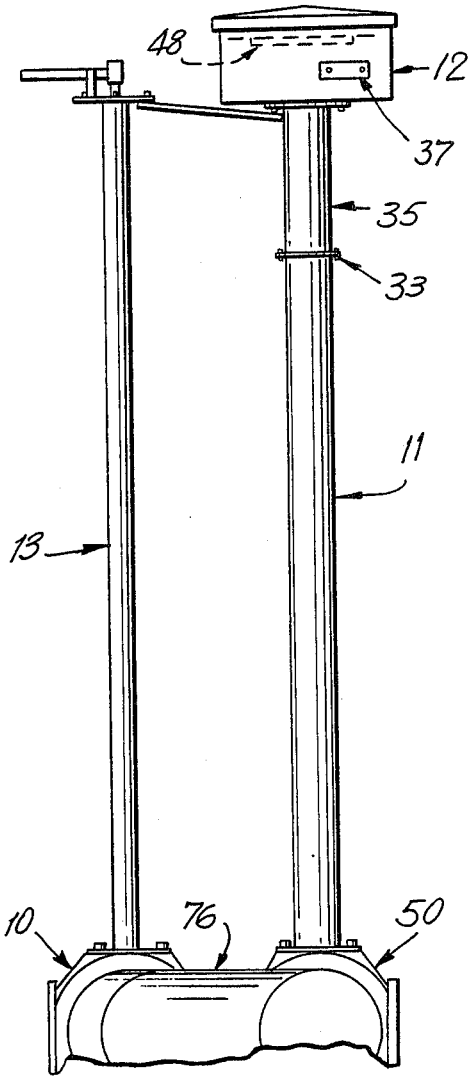
FIG. 7 is a side view of the installed surge irrigation system according to the invention.

Referring to FIG. 6 which is a downward view of surge irrigation system coupled in an underground pipe system using the by-pass tubes 76, 78 the water flows in from the pipe 17 and can flow out of 18, 19 or 20. With the disc 24 in the position shown, water could flow either out 18 or through by-pass tube 76 to 19, depending on which line has an open valve at the end. When electric valve disc 24 would change position 90 degrees, water would flow out pipe 20, but could not flow out by-pass tube 78 because of disc 24 position in manual valve 50. Thus, water could be switched by motor 28 back and forth watering either 18 and 20, or 19 and 20. Changing the manual valve position 90 degrees allows the combination of 18 and 20, or 18 and 19 Tubes 11 and 13 are connected to valve 10 and 50 with by-pass tubes 76, 78 to make the three direction system. Access plate 37 is preferably provided on box 12.

In operation, the user can surge irrigate any combination of two fields which may be widely separated from the control box 12. Hence, surge irrigation can be performed without recourse to additional piping or surface valves.

The foregoing is considered as illustrative only to the principles of the invention. Further, since numerous changes and modifications will occur to those skilled in the art, it is not desired to limit the invention to the exact construction and operation shown and described above, and accordingly all suitable modifications and equivalents may be resorted to, falling within the scope of the invention.

I claim:

1. A surge irrigation system for use in fields containing underground water supply pipes comprising:

a primary valve located underground on the underground water supply line;

said valve having at least two selectable outlet positions to direct the flow through the valve alternatively through the selectable outlets;

means to connect the primary valve outlets to separate underground pipes leading from said valve in different directions;

control means accessible to the surface for selectively switching said valve between its outlet positions according to a predetermined time schedule;

means connecting each separate pipe to the surface of a field for surge irrigation.

2. The surge irrigation system according to claim 1 further comprising:

a secondary valve located underground in fluid communication with said first valve;

said secondary valve having at least two selectable inlet positions, said secondary valve having at least one outlet;

means for connecting at least two of said outlets from said primary valve to at least two of the inlets of said secondary valve to allow for water flow through said secondary valve;

control means accessible to the surface for selectively switching said secondary valve between its inlet positions.

means to connect the secondary valve outlet to an underground irrigation pipe.

3. The surge irrigation system according to claim 2 wherein said primary valve has two outlets and said secondary valve has two inlets;

said primary valve outlets connected to a first and second underground irrigation pipe, said secondary valve outlet connected to a third underground irrigation pipe;

said outlet positions of said primary valve separately connected to said secondary valve inlets to allow for selectable flow from either primary valve outlets to said secondary valve.

4. An underground surge irrigation system for use in fields containing underground water supply pipes comprising:

a primary valve having an inlet, a first and second selectable outlet;

said primary valve located underground and connected to underground water supply line at its inlet;

a secondary valve located underground;

said secondary valve having a first and second inlet and an outlet;

means to connect said first outlet of said primary valve to a first underground irrigation pipe means;

means to connect said second outlet of said primary valve to a second underground irrigation pipe means;

means to connect said first and second primary valve outlets to said secondary valve inlets;

means to connect said outlet of said secondary valve to a third irrigation pipe means;

control means for selectively opening the primary valve outlets for a predetermined length of time;

control means for selectively opening the secondary valve inlets for a predetermined length of time;

whereby surge irrigation can be performed in any combination of the first, second or third irrigation pipe means according to a predetermined time schedule.

5. The underground surge irrigation system of claim 4 wherein said control means for selectively opening said outlets on said primary valve and said inlets in said secondary valve are located above ground.

6. A surge irrigation system for use in fields containing underground water supply pipes comprising:

a primary valve located underground having a first and second switchable outlet for alternately discharging water, said primary valve attached at its inlet to an underground water supply pipe;

said primary valve first outlet connected to a first underground irrigation pipe means;

said primary valve second outlet connected to a second underground irrigation pipe means;

a primary valve switching control means, activateable above ground for switching water discharge between said first and second outlet;

timer control means for activating said switching control means to allow water flow alternatively through the primary valve first and second outlets for preselected periods of time;

whereby surge irrigation is provided to fields located in different directions from a central control station.

7. The surge irrigation system according to claim 6, further comprising a secondary valve located underground having an outlet and a first and second switchable inlet for alternatively receiving inlet water;

said secondary valve outlet connected to a third underground irrigation pipe means;

said first outlet of said primary valve connected to said first secondary valve inlet and to said first irrigation pipe means;

said second outlet of said primary valve connected to said second, secondary valve inlet and to said second irrigation pipe means;

a secondary valve switching control means activateable above ground for switching water flow to said secondary valve between said first and second inlet;

whereby timed surge irrigation can be provided through any combination of two irrigation pipe means selected from the group of said first, second or third irrigation pipe means by activation from a centrally located control point.

8. The surge irrigation system according to claim 6 wherein said primary valve switching control means includes a motor located above ground;

a shaft connected to said primary valve to switch the water discharge between said first and second outlet upon rotation of the shaft;

said shaft connected to said motor for selective rotation.

9. The surge irrigation system of claim 1 wherein said primary valve is located in the horizontal plane of the underground water supply line.

10. The surge irrigation system of claim 9 wherein said control means is located above ground.

11. The surge irrigation system of claim 2 wherein said control means is located above ground.

12. The surge irrigation system of claim 11 wherein said control means includes a motor.

* * * * *